US011203799B2

(12) United States Patent
Kakitani

(10) Patent No.: US 11,203,799 B2
(45) Date of Patent: Dec. 21, 2021

(54) COPPER ALLOY STRIP EXHIBITING IMPROVED DIMENSIONAL ACCURACY AFTER PRESS-WORKING

(71) Applicant: JX Nippon Mining & Metals Corporation, Tokyo (JP)

(72) Inventor: Akihiro Kakitani, Kanagawa (JP)

(73) Assignee: JX Nippon Mining & Metals Corporation, Tokyo (JP)

( * ) Notice: Subject to any disclaimer, the term of this patent is extended or adjusted under 35 U.S.C. 154(b) by 187 days.

(21) Appl. No.: 16/496,258

(22) PCT Filed: Mar. 20, 2018

(86) PCT No.: PCT/JP2018/011144
§ 371 (c)(1),
(2) Date: Sep. 20, 2019

(87) PCT Pub. No.: WO2018/174079
PCT Pub. Date: Sep. 27, 2018

(65) Prior Publication Data

US 2020/0024695 A1 Jan. 23, 2020

(30) Foreign Application Priority Data

Mar. 21, 2017 (JP) ..... JP2017-054877

(51) Int. Cl.
*C22C 9/06* (2006.01)
*C22F 1/08* (2006.01)
(Continued)

(52) U.S. Cl.
CPC ..... *C22C 9/06* (2013.01); *B21B 3/00* (2013.01); *C22C 1/02* (2013.01); *C22F 1/08* (2013.01); *B21B 2003/005* (2013.01)

(58) Field of Classification Search
CPC .... C22C 9/06; C22C 1/02; C22C 9/02; C22C 9/04; C22C 9/05; C22C 9/10; C22F 1/08; B21B 3/00; B21B 2003/005; H01B 1/026
See application file for complete search history.

(56) References Cited

U.S. PATENT DOCUMENTS

2009/0257909 A1 10/2009 Mihara et al.
2010/0269959 A1 10/2010 Gao et al.
(Continued)

FOREIGN PATENT DOCUMENTS

JP 2006283059 A 10/2006
JP 200895185 A 4/2008
(Continued)

OTHER PUBLICATIONS

Akihiro, JP-2013204079-A, machine translation (Year: 2013).*
(Continued)

*Primary Examiner* — John A Hevey
(74) *Attorney, Agent, or Firm* — Faegre Drinker Biddle & Reath LLP

(57) ABSTRACT

Provided is a Corson alloy having improved bending workability and also having high dimensional accuracy after press-working. A copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material satisfies the relationship: $A^0/A \leq 1.000$, in which $A^0$ represents a projected area of an indentation remaining after carrying out a Vickers hardness test by maintaining a square pyramidal indenter for 10 seconds while applying a test force with a load of 1 kg to a surface of a base material and releasing the test force; and A represents an area connecting vertices of the indenter, and wherein the rolling material satisfies the rela-
(Continued)

tionship: $0.1 \leq I_{(200)}/I_{0(200)} < 1.0$, in which $I_{(200)}$ represents an X-ray diffraction intensity from a (200) plane on the surface, and $I_{0(200)}$ represents an X-ray diffraction intensity from a (200) plane of a pure copper powder standard sample.

9 Claims, 4 Drawing Sheets

(51) Int. Cl.
*B21B 3/00* (2006.01)
*C22C 1/02* (2006.01)

(56) References Cited

U.S. PATENT DOCUMENTS

| | | | | |
|---|---|---|---|---|
| 2015/0110668 | A1* | 4/2015 | Kuwagaki | C22C 9/06 420/473 |
| 2016/0305002 | A1 | 10/2016 | Kaneko | |

FOREIGN PATENT DOCUMENTS

| | | | | |
|---|---|---|---|---|
| JP | 2010275622 | A | | 12/2010 |
| JP | 201117072 | A | | 1/2011 |
| JP | 4857395 | B1 | | 1/2012 |
| JP | 2012177152 | A | | 9/2012 |
| JP | 2013104082 | A | | 5/2013 |
| JP | 2013163853 | A | | 8/2013 |
| JP | 2013204079 | A | * | 10/2013 |
| JP | 2013227642 | A | | 11/2013 |
| JP | 201586416 | A | | 5/2015 |
| WO | 2015099098 | A1 | | 2/2011 |
| WO | 2011068121 | A1 | | 6/2011 |
| WO | 2012160726 | A1 | | 11/2012 |
| WO | 2013161351 | A1 | | 10/2013 |
| WO | 2015146981 | A1 | | 1/2015 |

OTHER PUBLICATIONS

Extended European Searxh Report of EP18770302.0 related to PCT/JP2018011144, dated Oct. 1, 20, 8 pages.
International Preliminary Report on Patentability for PCT/JP2018/011144, from WIPO dated Oct. 3, 2019, 8 pages.
"Residual Stress and Warpage", Published by Uchida Rokakuho Publishing Co., Ltd., Tokyo, Japan, dated Jun. 30, 1988, 7 pages.
WIPO International Search Report for PCT/JP2018/011144 dated May 22, 2018, 4 pages.

* cited by examiner

[FIG. 1]
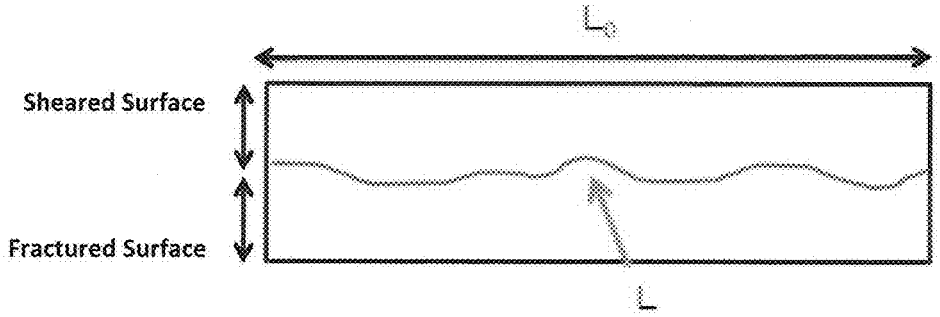

[FIG. 2]
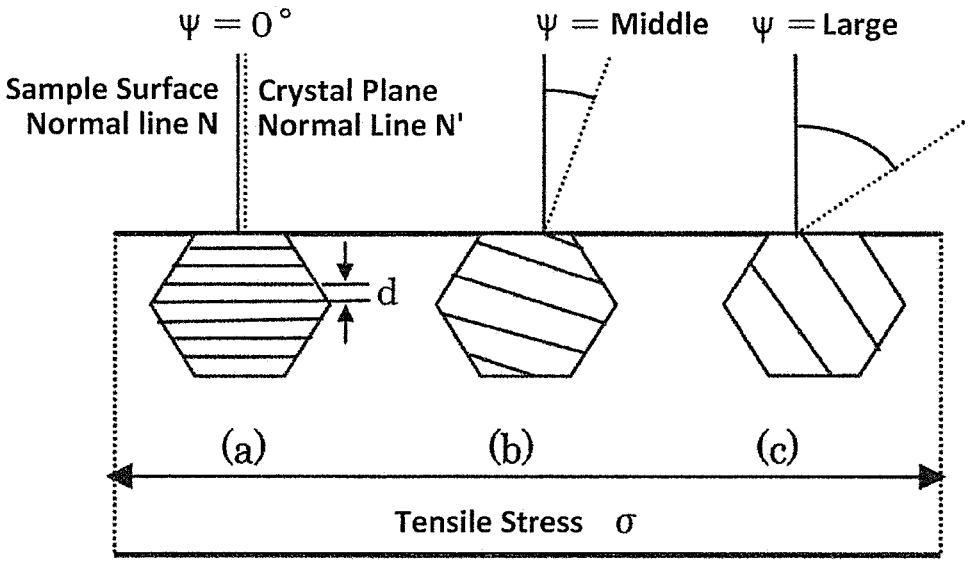

[FIG. 3]
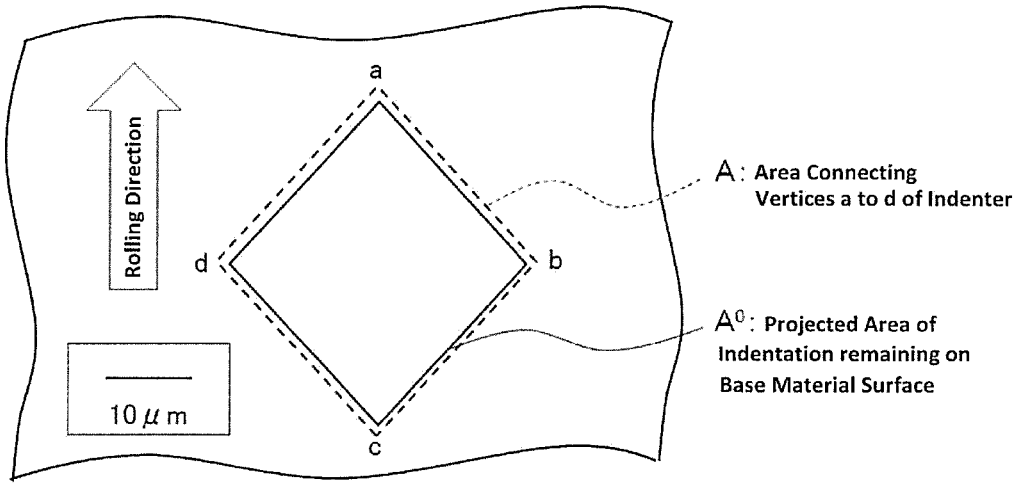

[FIG. 4]
(a)
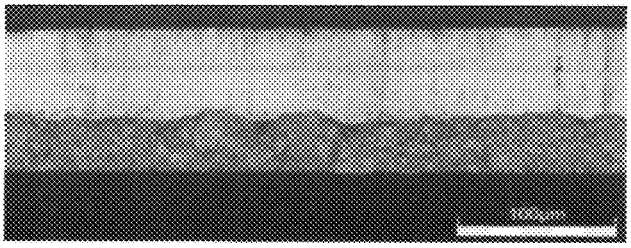
(b)
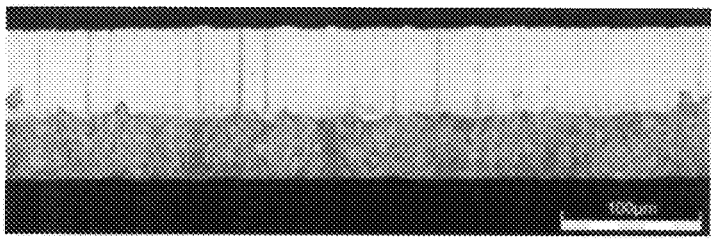
(c)
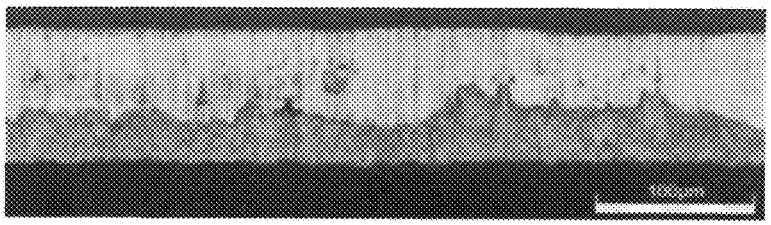

COPPER ALLOY STRIP EXHIBITING IMPROVED DIMENSIONAL ACCURACY AFTER PRESS-WORKING

TECHNICAL FIELD

The present invention relates to a Corson alloy having improved strength, bending workability, stress relaxation resistance, conductivity and the like, which is suitable as a conductive spring material such as a connector, a terminal, a relay, and a switch, and as a lead frame material for semiconductor devices, such as a transistor and an integrated circuit (IC). In particular, the present invention provides improved dimensional accuracy after press-working.

BACKGROUND ART

Recently, miniaturization of electric and electronic parts has progressed, and copper alloys used for these parts have been required to have good strength, conductivity and bending workability. In response to the requirement, a demand for precipitation-hardening copper alloys such as Corson alloys having high strength and conductivity has been increased in place of conventional solid solution-hardening copper alloys such as phosphor bronze and brass. The Corson alloy has intermetallic compounds such as Ni—Si, Co—Si, and Ni—Co—Si precipitated in a Cu matrix, and also has high strength, high conductivity, and good bending workability. In general, the strength and the bending workability are properties contrary to each other, and the Corson alloy is also desired to improve the bending workability while maintaining high strength. There is also a need for improvement of the press-punchability of the Corson alloy.

Recently, as a technique for improving the bending workability of Corson alloys, an approach for developing a {001}<100> orientation (Cube orientation) has been proposed. For example, Patent Document 1 (Japanese Patent Application Publication No. 2006-283059 A) discloses that an area ratio of the cube orientation is controlled to 50% or less to improve the bending workability by carrying out the steps of (1) casting, (2) hot rolling, (3) cold rolling (at a working ratio of 95% or more), (4) solutionizing treatment, (5) cold rolling (at a working ratio of 20% or less), (6) aging treatment, (7) cold rolling (at a working ratio of from 1 to 20%), and (8) short-time annealing in this order.

Patent Document 2 (Japanese Patent Application Publication No. 2010-275622 A) discloses that an X-ray diffraction intensity of (200) (which has the same meaning as {100}) is controlled to be equal or more than an X-ray diffraction intensity of a copper powder standard sample to improve the bending workability by carrying out the steps of (1) casting, (2) hot rolling (performed while decreasing a temperature from 950° C. to 400° C.), (3) cold rolling (a rolling rate of 50% or more), (4) intermediate annealing (450 to 600° C.; adjusting the conductivity to 1.5 times or more and adjusting the hardness to 0.8 times or less), (5) cold rolling (at a rolling rate of 70% or more), (6) solutionizing treatment, (7) cold rolling (a rolling rate of from 0 to 50%), and (8) aging treatment in this order.

Patent Document 3 (Japanese Patent Application Publication No. 2011-17072 A) controls an area ratio of Cube orientation to 5 to 60%, while at the same time controlling each of area ratios of Brass orientation and Copper orientation to 20% or less, to improve the bending workability. The best bending workability is obtained when the following steps are sequentially carried out: (1) casting, (2) hot rolling, (3) cold rolling (at a working ratio of from 85 to 99%), (4) heating treatment (at 300 to 700° C. for 5 minutes to 20 hours), (5) cold rolling (at a working ratio of from 5 to 35%), (6) solutionizing treatment (a heating rate of from 2 to 50° C./sec), (7) aging treatment, (8) cold rolling (at a working ratio of from 2 to 30%), and (9) temper annealing.

Patent Document 4 (Japanese Patent No. 4857395 B) controls an area ratio of Cube orientation to 10 to 80%, and each of area ratios of Brass orientation and Copper orientation to 20% or less, at a central portion in a thickness direction, to improve the notch bendability. It also discloses, as a production method for enabling notch bending, the following steps: (1) casting, (2) hot rolling, (3) cold rolling (at a working ratio of from 30 to 99%), (4) pre-annealing (at a softening degree of from 0.25 to 0.75; conductivity of from 20 to 45% IACS), (5) cold rolling (from 7 to 50%), (6) solutionizing treatment, and (7) aging.

Patent Document 5 (WO 2011/068121 A1) improves 180° tight bending property and stress relaxation resistance by controlling a ratio W0/W4 to 0.8 to 1.5 and W0 to 5 to 48% in which W0 is an area ratio of Cube orientation at a surface layer of a material and W4 is an area ratio of the Cube orientation at a ¼ position of the total depth of the material, and further adjusting an average grain size to 12 to 100 μm. It also discloses, as the production method, the following steps: (1) casting, (2) hot rolling (at a working ratio per pass of 30% or less, for a retention time period between the respective passes of 20 to 100 seconds), (3) cold rolling (at a working ratio of 90 to 99%), (4) heat treatment (at 300 to 700° C. for 10 seconds to 5 hours), (5) cold rolling (at a working ratio of 5 to 50%), (6) solutionizing treatment (at 800 to 1000° C.), (7) aging treatment, (8) cold rolling, and (9) temper annealing.

Patent Document 6 (Japanese Patent Application Publication No. 2012-177152 A) improves bending workability and stress relaxation resistance by having an average grain size of crystal grains of a copper alloy of from 5 to 30 μm, having an area occupied by crystal grains with a crystal grain size twice the average grain size of 3% or more, and having, among those crystal grains, an area ratio occupied by Cube orientation of 50% or more.

Patent Document 7 (Japanese Patent Application Publication No. 2013-227642 A) discloses that a relationship: $I_{(200)}/I_{0(200)} \geq 1.0$ is satisfied on a surface, and a relationship: $I_{(220)}/I_{0(220)}+I_{(311)}/I_{0(311)} \geq 1.0$ is satisfied in a cross section with a depth of from 45 to 55% relative to a plate thickness, whereby a Young's modulus in a rolling perpendicular direction is controlled while improving bendability.

Patent Document 8 (Japanese Patent Application Publication No. 2008-95185 A) reduces burrs after press punching by controlling a distribution of precipitates (intermetallic compounds of Ni and Si).

CITATION LIST

Patent Literatures

Patent Document 1: Japanese Patent Application Publication No. 2006-283059 A

Patent Document 2: Japanese Patent Application Publication No. 2010-275622 A

Patent Document 3: Japanese Patent Application Publication No. 2011-17072 A

Patent Document 4: Japanese Patent No. 4857395 B

Patent Document 5: WO2011/068121 A1

Patent Document 6: Japanese Patent Application Publication No. 2012-177152 A

Patent Document 7: Japanese Patent Application Publication No. 2013-227642 A

Patent Document 8: Japanese Patent Application Publication No. 2008-95185 A

SUMMARY OF INVENTION

Technical Problem

However, recently, miniaturization of connectors has promoted narrowing of a pitch (a distance between pins) of a multi-pin type connector produced by continuous pressing. In Corson alloys in which Cube orientation has been developed according to the prior art to improve the bendability, Young's modulus, stress relaxation characteristics, and the like for those small connectors, the pitch after pressing significantly varies, resulting in poor dimensional accuracy after press punching or subsequent bending, and poor product yield due to dimensional defects. On the other hand, in the material with reduced burrs during press punching as disclosed in Patent Document 8, the dimensional accuracy after press-working has not been improved.

Thus, an object of the present invention is to provide a Corson alloy having improved bending workability and also having high dimensional accuracy after press-working. Hereinafter, the quality of dimensional accuracy after pressing is referred to as a pressing property.

Solution to Problem

The present inventor has found that controlling of a projected area of indentations and crystal orientation of a plate thickness surface when the indentations are made on a surface of a Corson alloy can provide a Corson alloy having improved bending workability as well as a good pressing property, and also revealed a method for producing the same.

The present inventor has completed the following inventions based on the above findings:

(1)

A copper alloy strip which is a rolling material, the rolling material containing from 0 to 5.0% by mass of Ni or from 0 to 2.5% by mass of Co, the total amount of Ni+Co being from 0.2 to 5% by mass; from 0.2 to 1.5% by mass of Si, the balance being copper and unavoidable impurities, wherein the rolling material satisfies the relationship: $A^0/A \leq 1.000$, in which $A^0$ represents a projected area of an indentation remaining after carrying out a Vickers hardness test by maintaining a square pyramidal indenter for 10 seconds while applying a test force with a load of 1 kg to a surface of a base material and releasing the test force; and A represents an area connecting vertices of the indenter, and wherein the rolling material satisfies the relationship: $0.1 \leq I_{(200)}/I_{0(200)} < 1.0$, in which $I_{(200)}$ represents an X-ray diffraction intensity from a (200) plane on the surface, and $I_{0(200)}$ represents an X-ray diffraction intensity from a (200) plane of a pure copper powder standard sample.

(2)

The copper alloy strip according to (1), wherein an average grain size of a rolled surface is from 2 to 20 μm, as determined by a cutting method.

(3)

The copper alloy strip according to (1) or (2), wherein the copper alloy strip contains one or more of Sn, Zn, Mg, Cr and Mn in a total amount of from 0.005 to 2.0% by mass.

Advantageous Effects of Invention

According to the present invention, it is possible to provide a Corson alloy having an improved bending workability as well as a good pressing property.

BRIEF DESCRIPTION OF DRAWINGS

FIG. 1 is a schematic view illustrating a fractured surface and a sheared surface formed on a press-fractured surface in evaluation of a pressing property in Examples.

FIG. 2 is a schematic view for explaining a method of calculating a residual stress a when changing an angle ψ formed by a sample surface normal line N and a crystal plane normal line N' to investigate a change of its diffraction angle (2θ).

FIG. 3 is a view for explaining a method of calculating areas A and $A^0$ after a Vickers hardness test according to the present invention.

FIG. 4 is a view for explaining examples of determining a pressing property; FIG. 4 (*a*) shows Example 1, FIG. 4 (*b*) shows Example 12, and FIG. 4 (*c*) shows Comparison Example 1.

DESCRIPTION OF EMBODIMENTS

Hereinafter, embodiments of the present invention will be described in detail. First, it is described that a projected area ($A^0$) of an indentation remaining on a surface of a base material after a Vickers hardness test, and an area (A) connecting apices of an indenter, which are major features of the present invention.

A method of calculating the areas of $A^0$ and A is carried out as follows: first, in the Vickers hardness test, a square indenter is visually directed such that one of diagonal lines of the indenter is in parallel to a rolling direction, a test force of 9.8 N (1000 g) is applied to a surface of the base material and maintained for 10 seconds, and the test force is then released; subsequently, the projected area $A^0$ of the indentation produced by the Vickers hardness test and the area A connecting the apices of the indenter are calculated (see FIG. 3). The present inventor has found that $A^0/A \leq 1.000$ results in an improved pressing property. Although the lower limit is not particularly provided, it is often 0.95 or more because it allows the indentation to conform generally to the shape of the indenter.

The above evaluation is difficult to be verified for other objects than the surface of the material. For example, even if the same test is conducted on a rolled cross section, the effect cannot be verified. Moreover, for a low load during the hardness test, verification of the invention is difficult. In the Vickers hardness test of the surface of the material, the test load is generally changed according to the hardness and thickness of the material, and if the load is less than 4.9 N (500 g), verification of the effect will be difficult. When the evaluation is carried out with a thin plate, the test may be carried out by stacking materials such that the total thickness is 0.1 mm or more.

Although the present invention is not limited to the following descriptions, the relationship: $A^0/A \leq 1.000$ on the surface of the material is an index indicating fine hardness of the rolled surface and uniformity of the crystal grains, and $A^0$ would be larger than A if both a residual stress balance after pressing and the pressing property are poor. The ratio $A^0/A$ is preferably 0.995 or less, and more preferably 0.993 or less, and even more preferably 0.990 or less.

(Addition Amount of Ni, Co and Si)

Ni and Si are precipitated as intermetallic compounds such as Ni—Si and Ni—Si—Co by performing an appropriate aging treatment. The action of the precipitates improves the strength, and the precipitation decreases Ni, Co and Si dissolved in the Cu matrix to improve the conductivity. However, when the amount of Ni+Co is less than 0.2% by mass, crystal grains are coarsened by a solutionizing treatment, so that the pressing property is deteriorated.

It cannot allow for any desired strength, and conversely, an amount of Ni+Co of more than 5.0% by mass significantly deteriorates bending workability. Therefore, in the Corson alloy according to the present invention, the amount of Ni added is from 0 to 5.0% by mass, the amount of Co added is from 0 to 2.5% by mass, and the amount of Ni+Co is from 0.2 to 5.0% by mass. The amount of Si added is from 0.2 to 1.5% by mass. The amount of Ni added is more preferably from 1.0 to 4.8% by mass, the amount of Co added is more preferably 0 to 2.0% by mass, and the amount of Si added is more preferably from 0.25 to 1.3% by mass.

(Other Added Elements)

Sn, Zn, Mg, Cr, and Mn contribute to an increase in strength. Further, Zn is effective for improving thermal peeling resistance of Sn plating, Mg is effective for improving stress relaxation characteristics, and Cr and Mn are effective for improving hot workability. If the total amount of Sn, Zn, Mg, Cr and Mn is less than 0.005% by mass, the above effect cannot be obtained, and if it is more than 2.0% by mass, the bending workability is significantly reduced. Therefore, the Corson alloy according to the present invention preferably contains these elements in a total amount of from 0.005 to 2.0% by mass, and more preferably from 0.01 to 1.0% by mass.

(Average Crystal Grain Size)

In order to improve the bending workability and pressing property, an average crystal grain size is preferably from 2 to 20 μm when the metal structure on the surface of the rolled surface is observed to measure the average crystal grain size by a cutting method. If the average crystal grain size is 2 μm or less, non-recrystallization locally remains and the bending workability is deteriorated. On the other hand, if the average crystal grain size is 20 μm or more, the pressing property is deteriorated. From the viewpoint of achieving both of the good bending workability and the good pressing property, a more preferable range of the average crystal grain size is from 2 to 15 μm, and a still more preferable range is from 2 to 12 μm.

(Crystal Orientation)

In the present invention, measurement of θ/2θ is carried out on a plate surface of a rolled material sample by an X-ray diffraction method to measure an integrated intensity ($I_{(200)}$) of a diffraction peak of a (200) plane. At the same time, an integrated intensity ($I_{0(200)}$) of the diffraction peak of the (200) plane is also measured for copper powder as a randomly oriented sample. Then, using the value of $I_{(200)}/I_{0(200)}$, a degree of development of the (200) plane on the plate surface of the rolled material sample is evaluated. In order to obtain good pressing property, the ratio $I_{(200)}/I_{0(200)}$ on the surface of the rolled material is adjusted. Cube orientation can be said to be more developed as the ratio $I_{(200)}/I_{0(200)}$ is higher. When the ratio $I_{(200)}/I_{0(200)}$ is controlled to less than 1.0, the pressing property is improved. On the other hand, if the ratio $I_{(200)}/I_{0(200)}$ is less than 0.1, the bending workability is deteriorated.

(Pressing Property)

Dimensional accuracy after pressing should be generally evaluated after pressing a narrow pitch connector using an industrial facility. The pressing property (dimensional accuracy after pressing) is evaluated by carrying out a simple punching test to observe press fracture surfaces. In the present invention, a material is pressed using square punches each having one side of 10 mm and a clearance of 0.005 mm and dies, and the press fractured surfaces are observed. In the present invention, a mold with a movable stripper capable of fixing the material during pressing was used. When evaluating samples with different thicknesses, they are adjusted such that the clearance/thickness is in a range of from 5 to 8.5%.

(Production Method)

In a general process for producing a Corson alloy, first, raw materials such as electric copper, Ni, Co, Si and the like are melted in a melting furnace to obtain a molten metal having a desired composition. The molten metal is then cast into an ingot. It is then subjected to hot rolling, cold rolling, solutionizing treatment and aging treatment in this order and finished into a strip or foil having a desired thickness and characteristics. After the heat treatment, the surface may be subjected to washing with an acid, polishing or the like, in order to remove a surface oxide film generated during the heat treatment. Further, cold rolling may be performed between the solutionizing treatment and the aging or after the aging, in order to increase the strength.

In the present invention, a roller leveler step and a control of an arithmetic average roughness Ra of the surface of the cold-rolled material before the roller leveler step may be conducted before the solutionizing treatment in order to obtain $0.1 \leq I_{(200)}/I_{0(200)} < 1.0$ and $A^0/A \leq 1.000$.

The arithmetic average roughness of the surface of the cold-rolled material may be Ra≥0.15 μm. The arithmetic average roughness Ra refers to a roughness of the surface of the material after the rolling, which is determined based on JIS B0601 (2001). To achieve such an arithmetic average roughness Ra, a surface of a roll for rolling can be improved. If the arithmetic average roughness Ra is less than 0.15 μm, the crystal orientation $I_{(200)}/I_{0(200)}$ will be higher, so that the pressing property is deteriorated. If the arithmetic average roughness Ra is higher than 0.4 μm, the ratio $A^0/A$ are larger than 1.000, so that the bending workability and the pressing property may be deteriorated.

The roller leveler is used to apply a residual stress to the surface layer. In general, as the material passes between the rolls placed such that one is above the other, the bending forces act to introduce the residual stress. Conditions of the roller leveler were set to target the residual stress of the material. The residual stress on the product surface is 250 MPa or more, and preferably 265 MPa or more, and more preferably 280 MPa or more. If the residual stress is less than 250 MPa, any desired pressing property cannot be obtained. The upper limit of the residual stress is not particularly set, but it is desirable to adjust it as needed, in order to prevent difficulty in stable passing during roller leveling.

Here, the residual stress according to the present invention is determined by measuring a change in a (113) plane distance relative to an X-ray incident angle using the X-ray diffraction method. As a measurement direction, a direction parallel to the rolling direction is measured for the (113) plane, and a residual stress value occurring in this direction is determined. Although residual stress values may be measured for other crystal planes and directions, the measurement under those conditions results in the smallest variation in measurement and the best correlation between the residual stress value and the pressing property. In addition, the residual stress of a copper alloy sheet is often calculated from an amount of warpage of the sheet when etching the surface on one side of the sheet (Hajime Sudo: Residual Stress and Warpage, UCHIDA ROKAKUHO PUBLISHING CO., LTD. (1988), p. 46), the residual stress value obtained by this etching method had no correlation between the residual stress and the pressing property. In addition, it was difficult to obtain any desired residual stress by skin pass rolling in place of the roller leveler.

Thus, the order of the steps of the production method is as follows:

(1) casting of an ingot (having a thickness of from 20 to 300 mm);

(2) hot rolling (at a temperature of from 800 to 1000° C.; a thickness of from 3 to 20 mm);

(3) cold rolling (at a working ratio of from 80 to 99.8%; an arithmetic average roughness Ra≥0.15 μm);

(4) roller leveler (at a residual stress≥250 MPa);

(5) solutionizing treatment (at a temperature of from 700 to 980° C.);

(6) cold rolling (at a working ratio of from 0 to 50%);

(7) aging treatment (at a temperature of from 350 to 600° C. for 2 to 20 hours);

(8) cold rolling (at a working ratio of from 0 to 50%); and (9) strain relief annealing (at a temperature of from 300 to 700° C. for 5 seconds to 10 hours).

The cold rolling steps (6) and (8) are optionally carried out to increase the strength. However, while the strength is increased with an increase in the rolling working ratio, the bending workability tends to be deteriorated. When the working ratio of the step (6) or (8) is more than 50%, the ratio $I_{(200)}/I_{0(200)}$ will be less than 0.1, so that the bending workability is deteriorated.

If a solutionizing temperature is less than 700° C., non-recrystallization remains and the bending workability and pressing property are deteriorated. On the other hand, when the solutionizing temperature is 980° C. or more, the pressing property is deteriorated.

The strain relief annealing (9) is optionally performed to recover a spring limit value or the like which would otherwise be decreased by the cold rolling when the cold rolling (8) is performed. Regardless of the presence or absence of strain relief annealing (9), the effect of the present invention is obtained which achieve both of good bending workability and good pressing property by controlling the crystal orientation and controlling the area of the surface indentation.

In addition, for the steps (2), (3), (7) and (9), general producing conditions for Corson alloys may be selected.

(Application)

The Corson alloy according to the present invention can be processed into various copper rolled products such as plates, strips and foils. Further, the Corson alloy according to the present invention can be used for electric device parts such as lead frames, connectors, pins, terminals, relays, switches, foil materials for secondary batteries and the like. In particular, the Corson alloy according to the present invention is suitable as a part that is subjected to severe Bad Way bending.

EXAMPLES

Examples of the present invention are given below, but these Examples are provided for better understanding of the present invention and its advantages, and are not intended to limit the present invention.

Example 1

An alloy containing 2.6% by mass of Ni, 0.58% by mass of Si, 0.5% by mass of Sn and 0.4% by mass of Zn, and the balance being copper and unavoidable impurities, was used as an experimental material. The experimental material was subjected to studies for a relationship between pre-annealing conditions, light rolling conditions and rolling conditions before pre-annealing and the crystal orientation, and further effects of the crystal orientation on the bending workability and mechanical properties of the product.

2.5 kg of electric copper was melted in a high frequency melting furnace in an argon atmosphere using a graphite crucible having an inner diameter of 60 mm and a depth of 200 mm. Alloy elements were added to obtain the above alloy composition and a temperature of the molten metal was adjusted to 1300° C., and the molten metal was then cast in a cast iron mold to produce an ingot having a thickness of 30 mm, a width of 60 mm and a length of 120 mm. The ingot was processed in the following step order to produce a product sample having a plate thickness of 0.08 mm.

(1) Hot Rolling: The ingot heated at 950° C. for 3 hours was rolled up to 10 mm. The material after rolling was immediately cooled in water.

(2) Grinding: Oxide scales produced by hot rolling was removed by a grinder. A grinding amount was 0.5 mm per one side face.

(3) Cold Rolling: The cold rolling was performed to a predetermined thickness. The surface roughness of the material after rolling was obtained by adjusting the surface roughness of the work rolls during cold rolling.

(4) Roller Leveler: A total of 10 pairs of rolls were arranged vertically to control roll diameters and gaps between the upper and lower rolls to obtain a desired residual stress.

(5) Solutionizing Treatment: The sample and thermocouple were inserted into the electric furnace adjusted to 750 to 1200° C., and a temperature of the material was measured with the thermocouple, and the material was removed from the furnace at the time when the temperature of the material reached 700 to 980° C., and cooled by placing it in a water tank.

(7) Aging Treatment: The material was heated in an Ar atmosphere at 450° C. for 5 hours using an electric furnace.

(8) Cold Rolling: The cold rolling was performed at a working ratio of 20%.

(9) Strain Relief Annealing: The sample was inserted into an electric furnace adjusted to 400° C. and maintained for 10 seconds, and the sample was then left in the ambient air and cooled.

(0.2% Yield Strength)

A sample No. 13B defined in JIS Z 2201 was taken such that a tensile direction was parallel to the rolling direction, and subjected to a tensile test in a parallel direction to the rolling direction according to JIS Z 2241 to obtain 0.2% yield strength.

(Crystal Grain Size)

The rolled surface was etched to allow grain boundaries to appear. The crystal grain size was determined on the metallographic structure by the cutting method according to JIS H0501.

(W Bending Test of Product)

In accordance with JIS H3100, an inner bending radius was defined as t (thickness), and a W bending test was conducted in Bad Way direction (a direction where the bending axis was orthogonal to the rolling direction). The bent cross section was finished to have a mirror surface by mechanical polishing and buffing, and the presence or absence of cracking was observed by an optical microscope.

The W bending test was carried out under bending conditions of a ratio of a bending radius (R) to the thickness (t) was R/t=1.0, and a case where no cracking was observed was evaluated as "◎" (excellent), a case where no cracking was observed at R/t=1.5 was evaluated as "○" (good), and a case where cracking was observed at R/t=2.0 was evaluated as "x" (poor).

(Measurement of Conductivity of Product)

The conductivity of the product was determined by volume resistivity measurement using a double bridge in accordance with JIS H0505.

(Pressing Property)

The pressing was carried out by displacing a square punch having one side of 10 mm toward a die having a clearance of 0.005 mm at a rate of 2 mm/min while arranging the product between the punch and the die. The press fractured surface after pressing was observed with an optical microscope and the pressing property was evaluated at $L/L_0$ as shown in FIG. 1, in which $L_0$ is a width of the observed surface and L is the total length of a boundary between the sheared surface and the fractured surface. The total length L was calculated from a photograph of the observed surface using an image analysis software. The width $L_0$ of the observed surface was generally at least three times the thickness and measured at three positions. The observed surface was at a center of the press fractured surface in the width direction. In Table 3, the symbol "◎" indicates that the ratio $L/L_0$ was ($1<L/L_0\leq 1.05$), and the symbol "○" indicates that the ratio was ($1.05<L/L_0\leq 1.15$), and the symbol "x" indicates that the ratio was ($L/L_0>1.15$).

(Crystal Orientation)

For each sample, a diffraction intensity curve of the surface was obtained using a RINT 2500 X-ray diffractometer from Rigaku Corporation under the following measurement conditions, an integrated intensity I of the (200) crystal plane was measured, and an integrated intensity I of the (200) crystal plane was also measured for a pure copper standard sample under the same measurement conditions, and the ratio $I_{(200)}/I_{0(200)}$ was calculated.

Target: Co tube;

Tube Voltage: 30 kV;

Tube Current: 100 mA;

Scanning Speed: 5°/min;

Sampling Width: 0.02°; and

Measurement Range (2θ): 5° to 150°.

(Area Measurement after Hardness Test)

An indentation was made using a micro-Vickers hardness tester in accordance with JIS Z 2244. A Vickers hardness test was conducted by maintain a square pyramid-shaped indenter for 10 seconds while applying a test force of 1 kg load to the surface of the base material. A projected area ($A^0$) of the indentation after releasing the load and an area (A) connecting the apices of the indenter were determined using an image analysis software, and the ratio $A^0/A$ was calculated.

(Residual Stress)

For the (113) plane, the residual stress occurring in the direction parallel to the rolling direction was determined by the X-ray diffraction method. The principle and calculating equation for the stress measurement are shown below:

Principle of Residual Stress Measurement

As shown in FIG. 2, when a tensile residual stress is present, an angle ψ formed by a sample surface normal line N and a crystal plane normal line N' is changed to investigate a change in its diffraction angle (2θ). The residual stress a can be determined.

$$\sigma = -\frac{E}{2(1+\nu)}\cdot\cot\theta_0\cdot\frac{\pi}{180}\cdot\frac{\Delta(2\theta)}{\Delta(\sin^2\Psi)} = K\cdot\frac{\Delta(2\theta)}{\Delta(\sin^2\Psi)} \quad \text{[Equation 1]}$$

In the equation, a is a stress, E is a Young's modulus, v is a Poisson's ratio, and 80 is a standard Bragg angle. Also, K is a constant determined by the material and a measured wavelength. The relationship between 2θ and $\sin^2\psi$ is depicted in a diagram to obtain a gradient by the least squares method, and the gradient is multiplied by K to obtain a residual stress value.

Table 1 shows the alloy composition, Table 2 shows the producing conditions, and Table 3 shows the evaluation results. Further, for the rolled materials of Inventive Example 1, Inventive Example 12 and Comparative Example 1, photographs of fractured surfaces and sheared surfaces formed on the press fractured surfaces are shown in FIGS. 4 (*a*) to 4 (*c*), respectively.

TABLE 1

| | Component (% by mass) | | | | |
|---|---|---|---|---|---|
| | Ni | Co | Si | Ni + Co | Added Element |
| Example 1 | 2.6 | 0.0 | 0.58 | 2.6 | 0.5Sn, 0.4Zn |
| Example 2 | 1.6 | 0.0 | 0.36 | 1.6 | 0.5Sn, 0.4Zn |
| Example 3 | 3.8 | 0.0 | 0.78 | 3.8 | 0.13Mn—0.1Mg |
| Example 4 | 4.8 | 0.0 | 1.10 | 4.8 | 0.5Sn, 0.4Zn |
| Example 5 | 0.3 | 0.0 | 0.25 | 0.3 | — |
| Example 6 | 3.8 | 0.0 | 0.62 | 3.8 | 0.13Mn—0.1Mg |
| Example 7 | 1.8 | 1.1 | 0.60 | 2.9 | 0.1Cr |
| Example 8 | 0.5 | 1.5 | 0.63 | 2.0 | 0.1Cr |
| Example 9 | 2.3 | 0.0 | 0.52 | 2.3 | 0.13Mg |
| Example 10 | 4.0 | 0.5 | 0.81 | 4.5 | 0.05Mg |
| Example 11 | 2.6 | 0.0 | 1.10 | 2.6 | 0.5Sn, 0.4Zn |
| Example 12 | 1.3 | 0.6 | 0.50 | 1.9 | — |
| Example 13 | 0.0 | 1.9 | 0.45 | 1.9 | 0.1Cr |
| Example 14 | 2.8 | 0.0 | 0.6 | 2.8 | 0.5Sn, 0.4Zn |
| Example 15 | 2.8 | 0.0 | 0.6 | 2.8 | 0.5Sn, 0.5Zn |
| Example 16 | 0.0 | 1.9 | 0.45 | 1.9 | 0.1Cr |
| Example 17 | 0.0 | 2.4 | 0.45 | 2.4 | 0.1Cr |
| Example 18 | 2.8 | 0.0 | 0.6 | 2.8 | 0.5Sn, 0.8Zn |
| Example 19 | 2.8 | 0.0 | 0.6 | 2.8 | 0.5Sn, 0.9Zn |
| Example 20 | 2.8 | 0.0 | 0.6 | 2.8 | 0.5Sn, 0.10Zn |
| Example 21 | 2.8 | 0.0 | 0.6 | 2.8 | 0.5Sn, 0.11Zn |
| Comparative Example 1 | 2.8 | 0.0 | 0.6 | 2.8 | 0.5Sn, 0.12Zn |
| Comparative Example 2 | 2.8 | 0.0 | 0.6 | 2.8 | 0.5Sn, 0.16Zn |
| Comparative Example 3 | 2.8 | 0.0 | 0.6 | 2.8 | 0.5Sn, 0.16Zn |
| Comparative Example 4 | 2.8 | 0.0 | 0.6 | 2.8 | 0.5Sn, 0.18Zn |
| Comparative Example 5 | 2.8 | 0.0 | 0.6 | 2.8 | 0.5Sn, 0.19Zn |
| Comparative Example 6 | 2.8 | 0.0 | 0.6 | 2.8 | 0.5Sn, 0.22Zn |
| Comparative Example 7 | 2.8 | 0.0 | 0.6 | 2.8 | 0.5Sn, 0.24Zn |
| Comparative Example 8 | 4.5 | 0.7 | 1.1 | 5.2 | 0.1Cr |
| Comparative Example 9 | 0.2 | 0.0 | 0.2 | 0.2 | 0.1Cr |

TABLE 2

| | Cold Rolling | | Roller Leveler | | Solutionizing Material | Rolling 1 | Aging | Rolling 2 | Strain Relief |
|---|---|---|---|---|---|---|---|---|---|
| | Thickness (mm) | Surface Roughness (μm) | Present or Absent | Residual Stress (MPa) | Temperature (° C.) | Working Ratio(%) | Temperature (° C.) | Working Ratio (%) | Temperature (° C.) |
| Example 1 | 0.10 | 0.21 | Present | 300 | 740 | 0 | 450 | 20 | 400 |
| Example 2 | 0.21 | 0.21 | Present | 300 | 750 | 0 | 450 | 30 | 300 |
| Example 3 | 0.11 | 0.21 | Present | 300 | 750 | 0 | 450 | 30 | Absent |
| Example 4 | 0.11 | 0.21 | Present | 300 | 750 | 0 | 450 | 30 | Absent |
| Example 5 | 0.11 | 0.21 | Present | 300 | 750 | 0 | 450 | 30 | Absent |
| Example 6 | 0.05 | 0.21 | Present | 310 | 750 | 25 | 430 | 0 | Absent |
| Example 7 | 0.40 | 0.21 | Present | 310 | 800 | 0 | 450 | 0 | 400 |
| Example 8 | 0.10 | 0.19 | Present | 310 | 775 | 0 | 450 | 20 | 500 |
| Example 9 | 0.09 | 0.21 | Present | 310 | 780 | 0 | 450 | 15 | 350 |
| Example 10 | 0.20 | 0.22 | Present | 310 | 860 | 20 | 450 | 25 | 350 |
| Example 11 | 0.14 | 0.31 | Present | 310 | 780 | 10 | 500 | 20 | 650 |
| Example 12 | 0.15 | 0.16 | Present | 310 | 850 | 0 | 400 | 20 | 350 |
| Example 13 | 0.10 | 0.39 | Present | 310 | 820 | 0 | 450 | 20 | 350 |
| Example 14 | 0.10 | 0.21 | Present | 255 | 775 | 0 | 450 | 20 | 350 |
| Example 15 | 0.10 | 0.25 | Present | 450 | 750 | 0 | 450 | 20 | 350 |
| Example 16 | 0.10 | 0.23 | Present | 310 | 710 | 0 | 450 | 20 | 350 |
| Example 17 | 0.10 | 0.20 | Present | 310 | 970 | 0 | 450 | 20 | 350 |
| Example 18 | 0.11 | 0.25 | Present | 310 | 775 | 5 | 450 | 20 | 350 |
| Example 19 | 0.19 | 0.23 | Present | 310 | 750 | 47 | 450 | 20 | 350 |
| Example 20 | 0.08 | 0.22 | Present | 310 | 750 | 0 | 450 | 5 | 350 |
| Example 21 | 0.15 | 0.21 | Present | 310 | 750 | 0 | 450 | 47 | 350 |
| Comparative Example 1 | 0.10 | 0.23 | Present | 240 | 775 | 0 | 450 | 20 | 350 |
| Comparative Example 2 | 0.10 | 0.12 | Present | 310 | 750 | 0 | 450 | 20 | 350 |
| Comparative Example 3 | 0.10 | 0.42 | Present | 310 | 750 | 0 | 450 | 20 | 350 |
| Comparative Example 4 | 0.10 | 0.22 | Present | 280 | 680 | 0 | 450 | 20 | 350 |
| Comparative Example 5 | 0.10 | 0.22 | Present | 280 | 1000 | 0 | 450 | 20 | 350 |
| Comparative Example 6 | 0.21 | 0.22 | Absent | — | 775 | 52 | 450 | 20 | 350 |
| Comparative Example 7 | 0.17 | 0.22 | Absent | — | 775 | 0 | 450 | 53 | 350 |
| Comparative Example 8 | 0.10 | 0.22 | Present | 310 | 850 | 0 | 450 | 20 | 350 |
| Comparative Example 9 | 0.09 | 0.22 | Present | 310 | 775 | 0 | 450 | 15 | 350 |

TABLE 3

| | Product Characteristics | | | | | | | |
|---|---|---|---|---|---|---|---|---|
| | Thickness (mm) | Average Crystal Grain Size μm | Cube Orientation $I_{(200)}/I_{0(200)}$ | Indented Area after Vickers Test (A0/A) | 0.2% Yield Strength (MPa) | Conductivity (% IACS) | bending Workability | Pressing Property |
| Example 1 | 0.08 | 4.0 | 0.42 | 0.995 | 830 | 39 | ◎ | ◎ |
| Example 2 | 0.15 | 6.2 | 0.43 | 0.989 | 700 | 58 | ◎ | ◎ |
| Example 3 | 0.08 | 6.2 | 0.42 | 0.994 | 750 | 42 | ◎ | ◎ |
| Example 4 | 0.08 | 6.2 | 0.44 | 0.989 | 980 | 35 | ○ | ◎ |
| Example 5 | 0.08 | 18.0 | 0.41 | 0.965 | 650 | 78 | ◎ | ○ |
| Example 6 | 0.04 | 6.5 | 0.42 | 0.975 | 780 | 37 | ◎ | ◎ |
| Example 7 | 0.4 | 9.2 | 0.41 | 0.986 | 750 | 51 | ◎ | ◎ |
| Example 8 | 0.08 | 9.2 | 0.43 | 0.991 | 750 | 64 | ◎ | ◎ |
| Example 9 | 0.08 | 9.8 | 0.38 | 0.972 | 713 | 50 | ◎ | ◎ |
| Example 10 | 0.12 | 12.5 | 0.42 | 0.993 | 980 | 34 | ◎ | ◎ |
| Example 11 | 0.1 | 9.7 | 0.46 | 0.992 | 780 | 41 | ◎ | ◎ |
| Example 12 | 0.12 | 15.2 | 0.95 | 0.981 | 650 | 62 | ◎ | ○ |
| Example 13 | 0.08 | 12.1 | 0.12 | 0.995 | 680 | 67 | ○ | ○ |
| Example 14 | 0.08 | 8.2 | 0.42 | 0.995 | 740 | 41 | ○ | ○ |
| Example 15 | 0.08 | 4.3 | 0.24 | 0.978 | 760 | 38 | ◎ | ◎ |
| Example 16 | 0.08 | 2.2 | 0.21 | 0.995 | 750 | 37 | ○ | ○ |
| Example 17 | 0.08 | 18.5 | 0.43 | 0.994 | 750 | 38 | ◎ | ○ |
| Example 18 | 0.08 | 8.1 | 0.51 | 0.986 | 750 | 39 | ◎ | ◎ |
| Example 19 | 0.08 | 6.1 | 0.17 | 0.985 | 750 | 39 | ○ | ◎ |
| Example 20 | 0.08 | 5.9 | 0.49 | 0.982 | 750 | 38 | ◎ | ◎ |
| Example 21 | 0.08 | 5.4 | 0.18 | 0.984 | 760 | 37 | ○ | ◎ |
| Comparative Example 1 | 0.08 | 7.9 | 0.33 | 1.004 | 800 | 37 | ○ | X |
| Comparative Example 2 | 0.08 | 6.5 | 1.1 | 0.995 | 815 | 41 | ◎ | X |
| Comparative Example 3 | 0.08 | 6.8 | 0.08 | 1.12 | 832 | 42 | X | X |
| Comparative Example 4 | 0.08 | 1.5 | 0.25 | 1.12 | 650 | 38 | X | X |
| Comparative Example 5 | 0.08 | 22.1 | 1.1 | 1.06 | 820 | 39 | ○ | X |

TABLE 3-continued

| | Product Characteristics | | | | | | | |
|---|---|---|---|---|---|---|---|---|
| | Thickness (mm) | Average Crystal Grain Size μm | Cube Orientation $I_{(200)}/I_{0(200)}$ | Indented Area after Vickers Test (A0/A) | 0.2% Yield Strength (MPa) | Conductivity (% IACS) | bending Workability | Pressing Property |
| Comparative Example 6 | 0.08 | 9.1 | 0.08 | 1.09 | 810 | 38 | X | X |
| Comparative Example 7 | 0.08 | 9.2 | 0.07 | 1.18 | 800 | 38.5 | X | X |
| Comparative Example 8 | 0.08 | 6.5 | 0.85 | 0.987 | 950 | 39 | X | ◎ |
| Comparative Example 9 | 0.08 | 25.3 | 1.2 | 0.998 | 811 | 39 | ◎ | X |

What is claimed is:

1. A copper alloy rolled material strip, the rolled material strip containing (i) one or both of Ni and Co, where the Ni is from 0 to 5.0% by mass and the Co is from 0 to 2.5% by mass, and wherein the total amount of Ni+Co being from 0.2 to 5% by mass; (ii) from 0.2 to 1.5% by mass of Si, and (iii) the balance being copper and unavoidable impurities, wherein the rolled material strip satisfies the relationship: $A^0/A \leq 1.000$, in which $A^0$ represents a projected area of an indentation remaining after carrying out a Vickers hardness test by maintaining a square pyramidal indenter for 10 seconds while applying a test force with a load of 1 kg to a surface of a base material and releasing the test force; and A represents an area connecting vertices of the indenter, and wherein the rolled material strip satisfies the relationship: $0.1 \leq I_{(200)}/I_{0(200)} < 1.0$, in which $I_{(200)}$ represents an X-ray diffraction intensity from a (200) plane on the surface, and $I_{0(200)}$ represents an X-ray diffraction intensity from a (200) plane of a pure copper powder standard sample.

2. The copper alloy strip according to claim 1, wherein the copper strip has an rolled surface, and wherein an average grain size of a rolled surface is from 2 to 20 μm, as determined by a cutting method.

3. The copper alloy strip according to claim 1, wherein the copper alloy strip further contains one or more of Sn, Zn, Mg, Cr and Mn in a total amount of from 0.005 to 2.0% by mass.

4. The copper alloy strip according to claim 2, wherein the copper alloy strip further contains one or more of Sn, Zn, Mg, Cr and Mn in a total amount of from 0.005 to 2.0% by mass.

5. The copper alloy strip according to claim 1, wherein the copper alloy strip has a 0.2% yield strength of 650 MPa to 980 MPa and a conductivity of 34% IACS to 78% IACS.

6. The copper alloy strip according to claim 2, wherein the copper alloy strip has a 0.2% yield strength of 650 MPa to 980 MPa and a conductivity of 34% IACS to 78% IACS.

7. The copper alloy strip according to claim 1, wherein the copper alloy has a pressing property of $1 < L/L_0 \leq 1.15$, in which $L_0$ is a width of the observed surface and L is the total length of a boundary between the sheared surface and the fractured surface.

8. The copper alloy strip according to claim 2, wherein the copper alloy has a pressing property of $1 < L/L_0 \leq 1.15$, in which $L_0$ is a width of the observed surface and L is the total length of a boundary between the sheared surface and the fractured surface.

9. The copper alloy strip according to claim 5, wherein the copper alloy has a pressing property of $1 < L/L_0 \leq 1.15$, in which $L_0$ is a width of the observed surface and L is the total length of a boundary between the sheared surface and the fractured surface.

* * * * *